US008432248B2

(12) United States Patent
Sakai et al.

(10) Patent No.: US 8,432,248 B2
(45) Date of Patent: Apr. 30, 2013

(54) METHOD FOR MANUFACTURING A RESISTOR

(75) Inventors: Hiromu Sakai, Ina (JP); Hitoshi Amemiya, Ina (JP); Takanori Kikuchi, Ina (JP)

(73) Assignee: KOA Corporation, Ina-shi, Nagano (JP)

( * ) Notice: Subject to any disclaimer, the term of this patent is extended or adjusted under 35 U.S.C. 154(b) by 0 days.

(21) Appl. No.: 13/402,140

(22) Filed: Feb. 22, 2012

(65) Prior Publication Data

US 2012/0223807 A1 Sep. 6, 2012

(30) Foreign Application Priority Data

Mar. 3, 2011 (JP) ..... 2011-046310

(51) Int. Cl.
*H01C 1/142* (2006.01)

(52) U.S. Cl.
USPC ..... 338/327; 338/328; 29/610.1

(58) Field of Classification Search ..... 338/327, 338/328; 29/610.1
See application file for complete search history.

(56) References Cited

U.S. PATENT DOCUMENTS 3,474,305 A * 10/1969 Szupillo ..... 257/30
4,965,538 A * 10/1990 Mickey, III ..... 333/81 A
7,053,749 B2 * 5/2006 Ishida et al. ..... 338/324
7,733,211 B2 * 6/2010 Yoneda ..... 338/307

* cited by examiner

*Primary Examiner* — Kyung Lee
(74) *Attorney, Agent, or Firm* — Westerman, Hattori, Daniels & Adrian, LLP

(57) ABSTRACT

To provide manufacturing method for resistor that uses metal plate as resistance body, which can obtain desired accurate resistance value without trimming resistance body even if product becomes small. The method comprises; in method for manufacturing an unit resistor that has a pair of electrodes separated by insulation film, from resistor material that is provided with a metal plate consisting of resistance material, an insulation film pattern formed on the metal plate, and an electrode region formed besides area where insulation film pattern has been formed, by piercing predetermined piercing area, wherein length E of insulation film pattern is longer than width w of piercing area, wherein width L of insulation film pattern extends or narrows along direction of length E of insulation film pattern, and wherein position X of piercing area is adjusted in extent and in direction of length E of insulation film pattern.

4 Claims, 5 Drawing Sheets

METHOD FOR MANUFACTURING A RESISTOR

BACKGROUND OF THE INVENTION

1. Field of the Invention

The present invention relates to a resistor for detecting current, and the resistor uses metal plate as resistance body.

2. Description of the Related Art

In the past, a resistor that uses metal plate such as Ni—Cr system alloys as resistance body for current detection is known. For instance, in a case of minute size of 1005 size (1.0 mm×0.5 mm) etc., the resistor can be formed by piercing process etc. from a large size metal plate material that can produce a lot of pieces. In this case, because it is not possible to trim resistance value of the resistor at the stage of piercing processing of the metal plate material, it is necessary to trim one by one to desired resistance value in accuracy after making it to pieces by piercing processing etc.

In the field of resistor for current detection usage, there is a problem that causes inductance element to the resistor by trimming method of forming trim cut by laser trimming etc., which is used for usual chip resistor etc. Then, it has been proposed a trimming method that does not cause any inductance element by cutting resistance body in parallel to electrical current direction thereof (Japanese laid-open patent publication 2002-57009).

However, since each resistance body is not independent on the metal plate material of large size, it is difficult to make trimming and it is necessary to make trimming one by one after making it pieces from large size metal plate. There is a problem that this work becomes troublesome and a factor of cost increasing. Then, by forming accurately an insulation layer on inter-electrode with thick film patterning, and providing accurate electrode positions, and by finishing up size of resistance body in high accuracy, a manufacturing method of a resistor, which enables trimming unnecessary, is proposed (Japanese laid-open patent publication 2004-63503).

SUMMARY OF THE INVENTION

However, resistance value of resistance body that consists of metal plate is determined by not only distance between the electrodes but also thickness of the resistance body. For instance, in a case of minute size resistor of 1005 size (1.0 mm×0.5 mm) etc., if you try to obtain the resistance value of several mΩ, thickness of the resistance body becomes 0.2 mm or less, and it is difficult to obtain high accuracy of dimensions according to this thickness even if it uses Ni—Cr system alloy that has comparatively high resistivity.

The present invention has been made basing on above-mentioned circumstances. It is therefore an object of the present invention to provide a manufacturing method of a resistor that uses metal plate as resistance body, which can obtain desired accurate resistance value without trimming the resistance body even if the product becomes small.

The method for manufacturing a resistor according to present invention comprises; in the method for manufacturing an unit resistor that has a pair of electrodes separated by insulation film, from resistor material that is provided with a metal plate consisting of resistance material, an insulation film pattern formed on the metal plate, and an electrode region formed besides area where the insulation film pattern has been formed, by piercing a predetermined piercing area, wherein a length E of the insulation film pattern is longer than a width w of the piercing area, wherein the width L of the insulation film pattern extends or narrows along direction of the length E of the insulation film pattern, and wherein a position X of the piercing area is adjusted in extent and in direction of the length E of the insulation film pattern (See FIG. 2). The "side" indicates corresponding upper or bottom side of the insulation film, for instance, C2,D2 in FIG. 1B. Moreover, though "the electrode region" in present invention indicates the plating adhesion region to become an electrode when it is cut out to the resistor, it might indicate all of plating adhesion region except the insulation film pattern on the metal plate.

According to the present invention, because width L of the insulation film pattern extends or narrows along direction of length E of the insulation film pattern, by adjustment of position of piercing area X in direction of length E of the insulation film pattern within extent of length E of the insulation film pattern, distance L between electrodes, which is substantial length of the resistance body of the resistor, is changed. As a result, a minute adjustment of resistance value becomes possible. Therefore, even if the resistor becomes small, the metal plate thins, and the difference exists in the thickness thereof, the resistor that adjusts resistance value in high accuracy can be produced by adjusting the position of piercing area X without trimming for adjusting resistance value by cutting or so on. According to the resistor, since distance between a pair of electrodes is formed longer at one side and shorter at the other side, direction of the resistor when taping or mounting may be arranged by the method such as measuring the distance between the electrodes.

DETAILED DESCRIPTION OF THE PREFERRED EMBODIMENTS

Figure 1A:
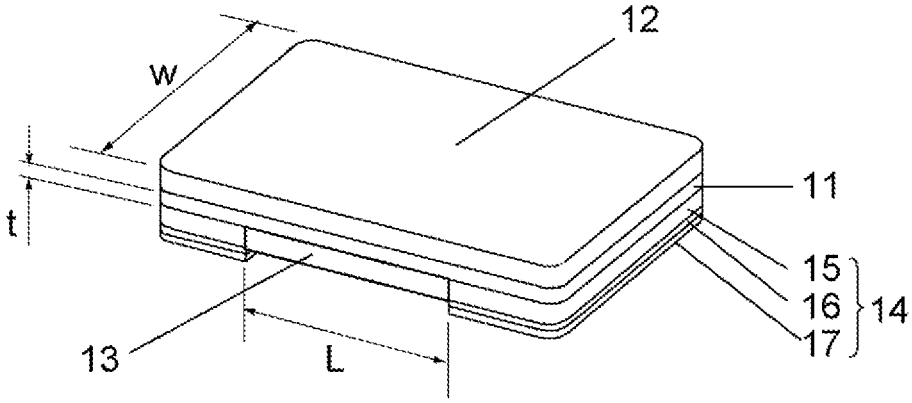
FIG. 1A is a perspective view of the resistor according to the present invention.

Embodiments of the present invention will be described below with referring to FIG. 1A-FIG. 6. Like or corresponding parts or elements will be denoted and explained by the same reference characters throughout views.

As shown in FIG. 1A, the resistor is provided with a metal plate 11 consisting of resistance material such as Ni—Cr system alloy or Cu—Ni system alloy, an insulation film 12 formed on a surface of the metal plate 11, an insulation film 13 formed on central portion of the other surface of the metal plate 11, and a pair of electrodes 14,14 formed besides the area where insulation film 13 on the other surface of the metal plate has been formed. Insulation films 12,13 are formed with epoxy resin. Electrode 14 consists of Cu plating layer 15, Ni plating layer 16, and Sn plating layer 17. Further, though insulation film 12 is formed on a surface of the metal plate 11 in this embodiment, the insulation film 12 may not be formed.

Figure 1B:
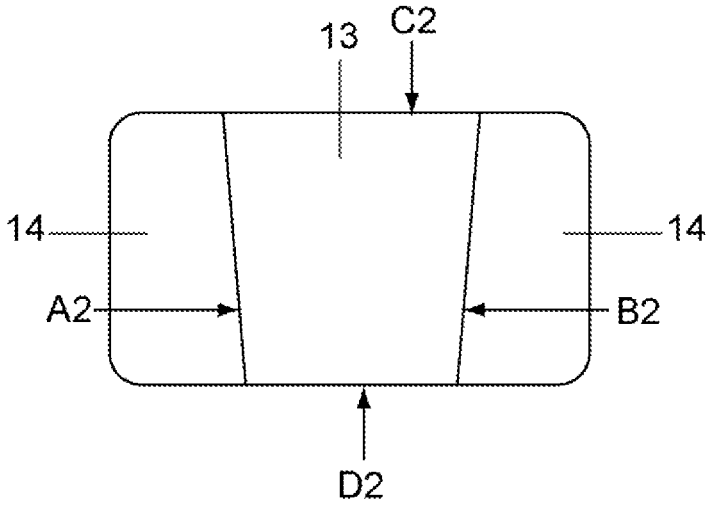
FIG. 1B is a bottom view of the resistor according to the present invention.

As shown in FIG. 1B, insulation film 13 and pair of electrodes 14,14 formed besides area where insulation film 13 has been formed are arranged at bottom surface of the resistor. Distance L between pair of electrodes 14,14 is not constant, and it extends at upper side and it narrows at lower side. That is, lengths of upper side C2 and lower side D2 of insulation film 13 is different each other, and width L of insulation film 13 is formed as wider at upper part and as narrower at lower part in the figure. And, as shown in FIG. 2 and FIGS. 3A-3D, the shape of the resistor is formed by cut out of piercing prescribed piercing area X from resistor material, which is provided with insulation film pattern 13*a* of trapezoidal shape and electrode region 14*a* formed besides the area where insulation film pattern 13*a* has been formed on metal plate material 11*a*.

In general, resistance value of metal plate resistor is shown by following expression.

$$R=\rho\times L/(w\times t)$$

Here, R: resistance value, ρ: resistivity, w: width of resistance body, t: thickness of resistance body, and L: distance between electrodes (substantial resistance body length).

Here, resistivity ρ is determined by resistance material, width w of resistance body is determined by each product, and thickness t of resistance body is determined by thickness of metal plate material. When there is no uniformity in thickness t of metal plate material, variation of thickness t causes error of resistance value R directly. Therefore, there is a problem that it is necessary for making thickness t uniform over the whole with high accuracy.

However, difference of thickness exists at every one sheet of metal plate material, which is cut into proper size sheet, and moreover, difference of thickness exists also in a sheet of metal plate material. Then, according to the present invention, length E of insulation film pattern 13*a* is longer than width x of piercing area X, each side edge A, B, where width of insulation film pattern 13*a* is formed, is not parallel, and position X of piercing area is adjusted in extent of length E and in direction of length E of insulation film pattern 13*a*.

Figure 2:
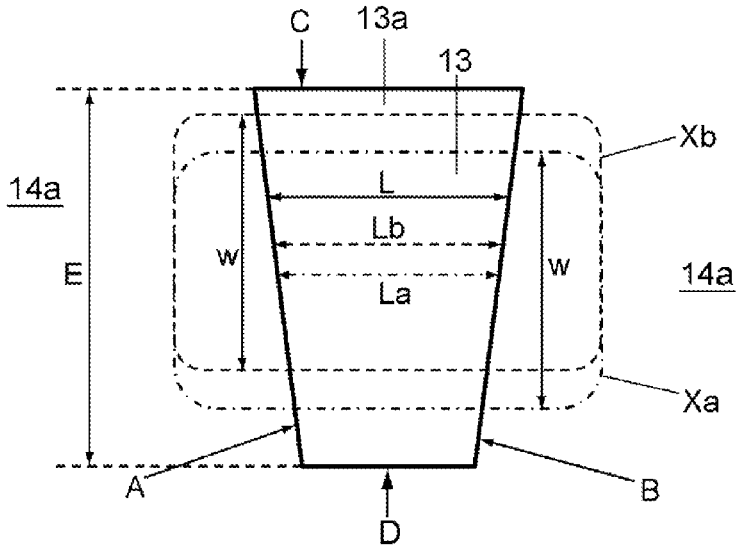
FIG. 2 is a plan view, which shows a detail of piercing area on the metal plate.

Accordingly, even if difference exists in thickness of metal plate material 11*a*, by adjustment of position X of piercing area in direction of length E of insulation film pattern 13*a* within extent of length E of the insulation film pattern, substantial distance L between electrodes can be adjusted, and resistance value in desired tolerance can be obtained. That is, as shown in FIG. 2, average inter-electrode distance La can be adjusted to Lb by adjusting piercing position Xa to Xb, and minute adjustment of resistance value becomes possible. Therefore, even if difference of thickness exists in metal plate 11*a*, resistors whose resistance value has been adjusted at high accuracy can be produced without installing trimming process after dividing into pieces.

Next, an embodiment of manufacturing process of the resistor will be described with referring to FIG. 3A-FIG. 3D. First, metal plate material 11*a* that consists of resistance material such as Ni—Cr system alloy and Cu—Ni system alloy is prepared (see FIG. 3A). Insulation film patterns 12*a* and 13*a* are formed by printing epoxy resin on both surfaces of metal plate material 11*a* (see FIG. 3B). In this embodiment, a plural of insulation film pattern 13*a* of trapezoidal shape is formed on one surface of metal plate material 11*a* where electrode 14*a* will be formed later (See FIG. 3C). Moreover, insulation film pattern 12*a* is formed to all aspects on the other surface of metal plate material 11*a*. However, Insulation film pattern 12*a* may not be formed.

Figure 4A:
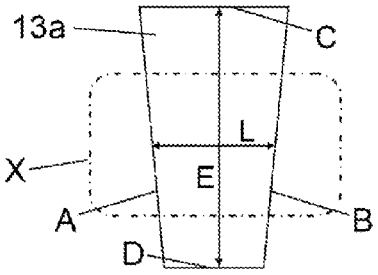
FIG. 4A-4G are views, which show various shapes of the insulation film patterns.

In this embodiment, an example is shown in FIG. 4A, where each side A, B of insulation film pattern 13*a* is not parallel, that is, trapezoid shaped. As for shape of insulation film pattern 13*a*, distance between left and right sides A, B is different at upper and lower sides C, D. That is, distance L between left and right sides A, B increases or decreases along length direction E of insulation film pattern 13*a*. Insulation film pattern 13*a* only has to be shape that inter-electrode distance L extends along direction toward one of upper or lower side, and not limited to trapezoid shape like FIG. 4A.

Figure 4B:
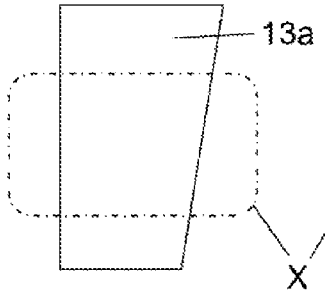
Figure 4C:
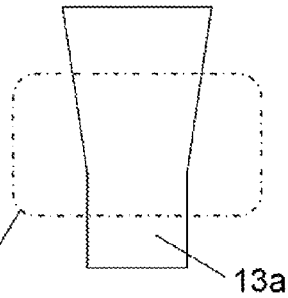
Figure 4D:
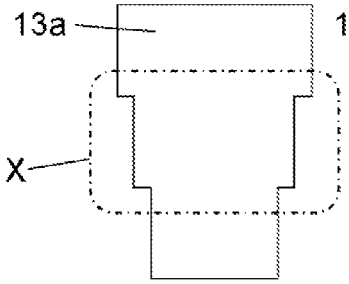

FIGS. 4B-4G show examples of variations of the insulation film pattern shape. An example shown in FIG. 4B is a trapezoid shape of the insulation film pattern to extend inter-electrode distance along direction toward one of upper or lower side where one of left or right side is approximately vertical and the other left or right side is inclined. In other variations, left and right sides may be asymmetry like this. An example shown in FIG. 4C is a shape where left and right sides is approximately parallel in the part where distance thereof is narrowest. An example shown in FIG. 4D is a shape where distance between left and right sides extends (or narrows) like steps.

Figure 4E:
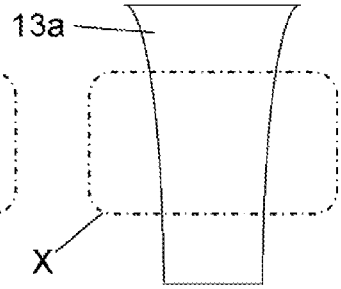
Figure 4F:
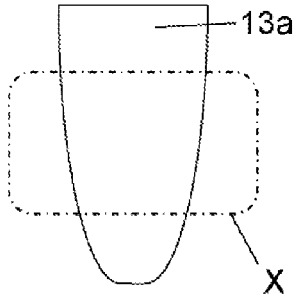
Figure 4G:
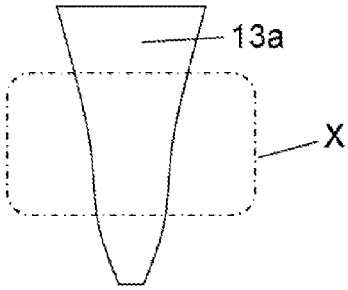

An example shown in FIG. 4E is a shape to curve left or right side toward inside gradually so as to extend distance between thereof toward one of upper or lower side. An example shown in FIG. 4F is a shape to curve left or right side toward outside gradually so as to extend distance between thereof toward one of upper or lower side. An example shown in FIG. 4G is a shape that corresponds to combination of FIGS. 4E and 4F to extend insulation film pattern toward one of upper or lower side by curving left and right side toward inside on the way, and curving it toward outside. Though insulation film patterns shown in FIGS. 4C-4G are formed symmetry regarding to left and right sides, one of left or right side may be formed straight to be approximately vertical or to be inclined toward one of upper or lower side.

In case of forming shape of the insulation film pattern as shown in FIG. 4A or 4B, since resistance change rate by movement of piercing position becomes constant, there is an advantage of adjusting resistance value easily. In case of forming shape of the insulation film pattern as shown in FIG. 4A, since both sides are inclined, resistance change rate by movement of piercing position becomes larger than shape of FIG. 4B, then there is an advantage that length of insulation film pattern that is span of adjustable range can be also short. In case of forming shape of the insulation film pattern as shown in FIG. 4C, resistance adjustment sensitivity becomes lower compared with the shape shown in FIG. 4A. Therefore, width of resistance adjustment becomes small though resistance value can be gradually adjusted. According to shape of FIG. 4D, width of resistance adjustment can be changed by changing size and number of the steps.

In the shape shown in FIG. 4E or 4F, when the curve is enlarged, resistance adjustment sensitivity has tendency to rise compared with the shape of FIG. 4A. Therefore, resistance value can be greatly changed only by changing the piercing position a little. On the other hand, resistance adjustment sensitivity lowers when degree of the curve is reduced, and resistance value can be changed gradually. FIG. 4G is a shape, which can easily enlarge change of resistance value by movement of the piercing position, and change of resistance value becomes largest among shapes shown in FIGS. 4A-4G. Further, resistance adjustment sensitivity=resistance change rate/movement of the piercing position.

In addition, insulation film pattern 13*a* is formed so that length E of the insulation film pattern in direction thereof is formed longer than width w of piercing area X. As a result, span of adjustable range of the piercing position extends, and resistors having good resistance value accuracy can be obtained.

Figure 3A:
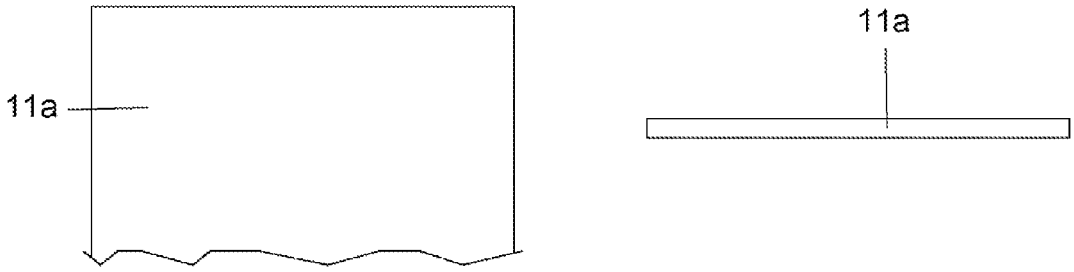
FIG. 3A is a plan view (left side) and a cross-sectional view (right side), which shows a stage where metal plate material is prepared.
Figure 3B:
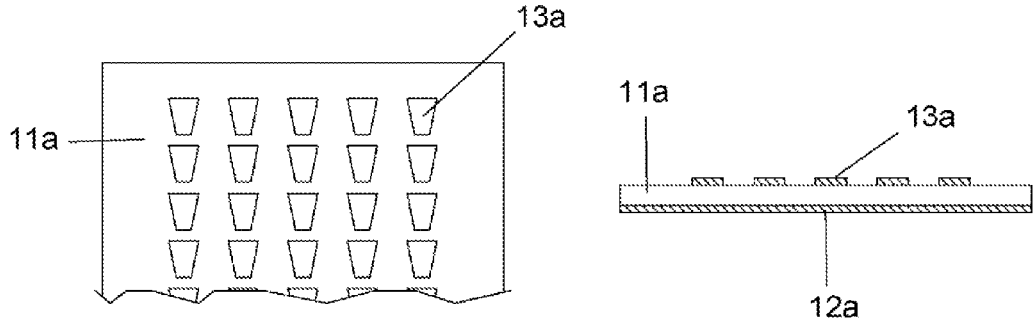
FIG. 3B is a plan view (left side) and a cross-sectional view (right side), which shows a stage where insulation film pattern is formed on both faces of metal plate.
Figure 3C:
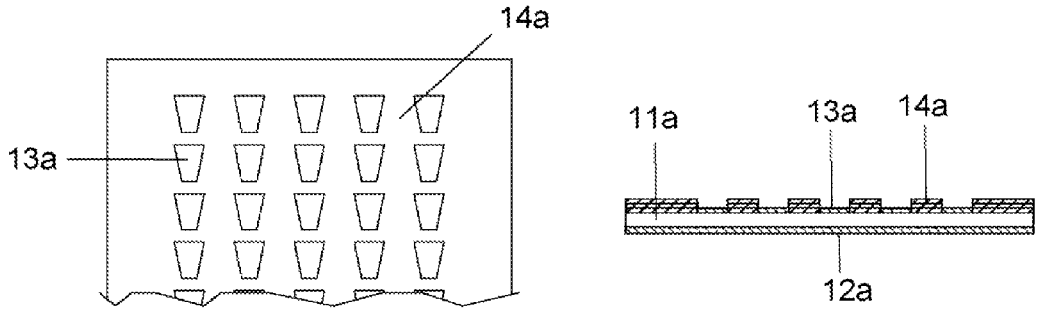
FIG. 3C is a plan view (left side) and a cross-sectional view (right side), which shows a stage, where electrode region is formed.

Next, electrode 14, for instance, consisting of three layers (Cu layer 15, Ni layer 16, and Sn layer 17), is sequentially formed by plating to area besides insulation film pattern 13*a* was formed on surface of metal plate 11*a* (See FIG. 3C). Furthermore, electrode 14 may be formed not limited to as a pair, but may be formed as two pairs so as to be so called four terminals. Though, the electrode is formed with electrolysis plating in this embodiment, however, it is also possible to use methods such as non-electrolyte plating, sputtering, and vapor deposition, etc.

Figure 3D:
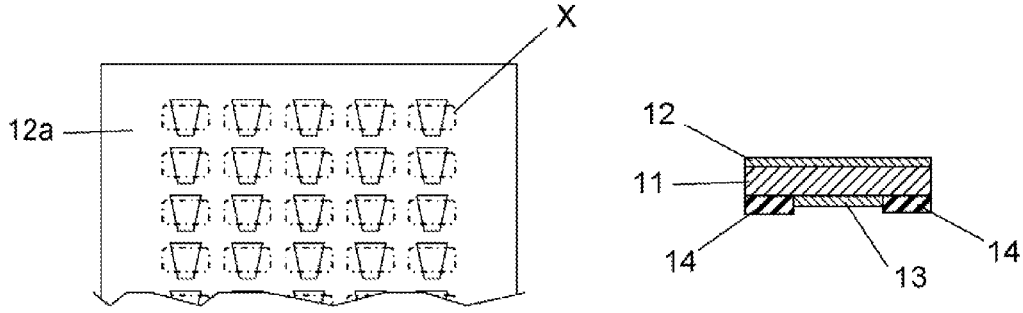
FIG. 3D is a plan view (left side) and a cross-sectional view (right side), which shows a stage, where piercing area is pierced. The cross-sectional view shows a pierced resistor after piercing.

Afterwards, by piercing metal plate 11*a* to pieces while adjusting resistance value, the resistor is formed (see FIG. 3D). An adjusting method of resistance value in this piercing process measures a resistance value of resistor pierced ahead, and determines piercing position of following resistor based on the resistance value. At this time, resistor pierced ahead is a resistor pierced just before, a resistor pierced 2-10 pieces before, or an adjoining resistor, etc.

Figure 5:
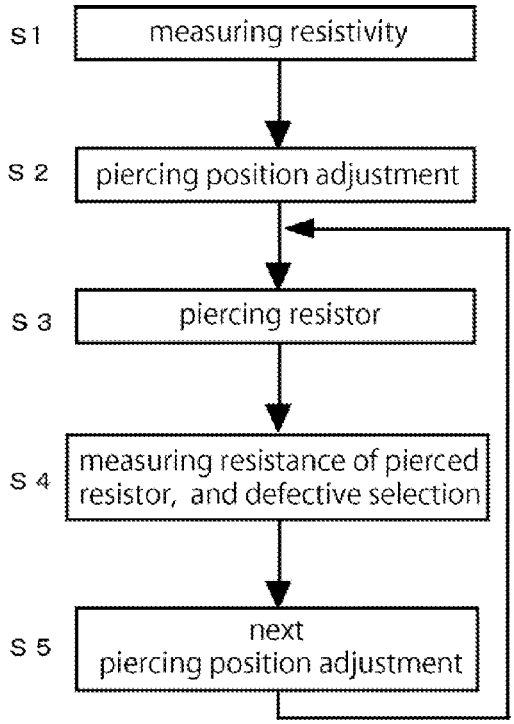
FIG. 5 is a flow-chart, which shows piercing process.

FIG. 5 shows a flow of the piercing process. Calculation of first piercing position of the resistor is made basing on resistivity value of metal plate material 11*a*. The resistivity value may be determined from specification data or measured data by cutting out a part of metal plate material 11*a*. In this embodiment, first, measuring of resistivity value of metal plate material 11*a* is made (S1). And by basing on the resistivity value, resistance value of inter-electrode in piercing area X is calculated, the calculated data is memorized, and the piercing position is calculated so as to be resistance value of the resistor to be produced. Data concerning change of resistance value according to movement of piercing position has been accumulated beforehand in controller by simulation or experimental examination, etc. And, piercing position is adjusted (S2) by moving metal plate 11*a* to piercing position according to calculated value by calculation, and piercing the resistor is carried out (S3).

Since left and right sides A,B of insulation film pattern 13*a* is formed not to be parallel on metal plate 11*a*, substantial length of resistance body, that is, inter-electrode distance L can be minutely changed by adjusting piercing position, and resistance value of the resistor can be adjusted with good accuracy. Furthermore, though a shape of left and right sides A,B of insulation film pattern 13*a* being not parallel is shown in this embodiment, it is not limited to this example. If it is shape that width of insulation film pattern extends or narrows along direction of length E of insulation film pattern 13*a*, left and right sides A, B of insulation film pattern 13*a* may be parallel.

In addition, resistance value between electrodes of pierced resistor is measured and memorized, and defective selection (S4) is carried out by distinguishing whether resistance value of pierced resistor is within predetermined resistance range or not. Next, calculating piercing position of resistor to be pierced next with basing on measured resistance value, adjusting piercing position by moving metal plate material 11*a* (S5), and piercing the resistor (S3), are carried out. Steps S3-S5 is repeated at the following. Further, adjustment of piercing position by movement of metal plate 11*a* can use a method of detecting moved distance with an encoder, a method by image analysis, or other proper method.

Figure 6:
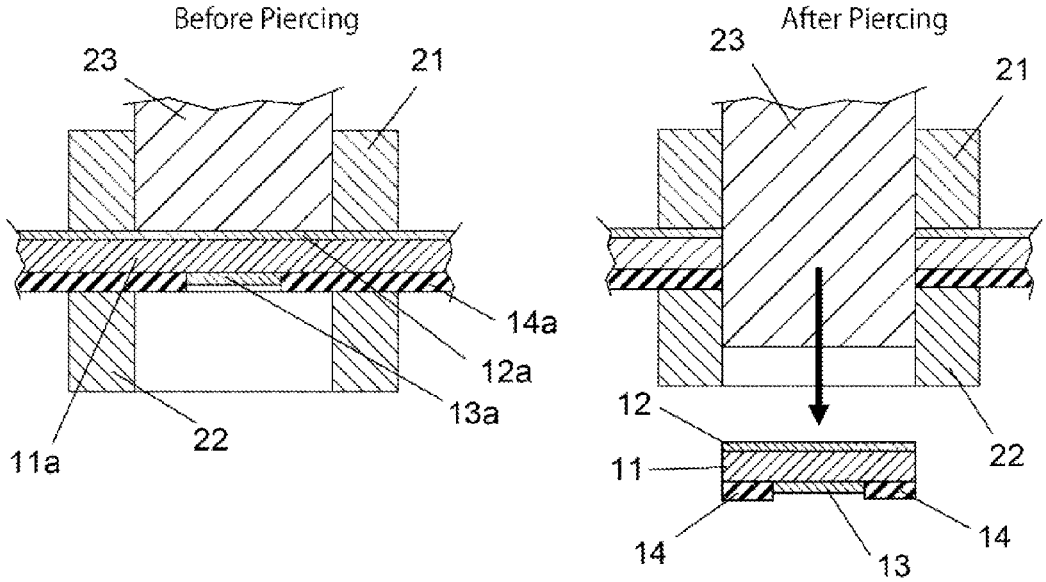
FIG. 6 is a cross-sectional view (before piercing at left side) and a cross-sectional view (after piercing at right side), where a detail of the piercing process is shown.

In piercing process, metal plate material 11*a* that has been adjusted to piercing position is placed and held by guide 21 and die 22 as shown in FIG. 6 (Left picture). And, piercing is done by depressing punch 23 (FIG. 6 Right picture). Direction of face in respect of metal plate material 11*a* is arranged so that electrode region 14*a* faces below. As a result, burr generated by piercing process is formed in opposite direction respect to mounting surface, the resistor can be prevented from deterioration of characteristics by stress concentration to portion of burr, and from inclining when mounting by flatness of mounting surface being lost by burr.

In case of metal plate material 11*a* being a large size substrate that can produce a lot of pieces and that has many rows, piercing of next row is similarly carried out with adjusting resistance value of the resistor. In case of using the large size substrate, insulation film pattern 13*a* may be formed not individually like an independent island as shown in FIG. 3, but may be formed consecutively, for instance, where all or parts of insulation film pattern 13*a* that is lined up vertically in FIG. 3 is mutually connected. However, in case that insulation film pattern 13*a* is formed individually like an island, when adjusting piercing position, a portion of insulation film pattern 13*a* can be set as a standard position for image analysis, and piercing position can be adjusted by setting moving distance to the standard position. Besides, instead of using a large size rectangle substrate that can produce a plural of pieces, using a long length metal plate material (so-called hoop material) that is pierced in a line, also be possible.

Although embodiments of the invention has been explained, however the invention is not limited to above embodiments, and various changes and modifications may be made within scope of technical concept of the present invention.

Industrial Applicability

The present invention can be suitably applicable to a resistor for current detection usage that uses metal plate as resistance body.

What is claimed is:

1. A method for manufacturing a resistor, comprising:

in the method for manufacturing an unit resistor that has a pair of electrodes separated by insulation film, from resistor material that is provided with a metal plate consisting of resistance material, an insulating film pattern formed on the metal plate, and an electrode region formed besides area where the insulation film pattern has been formed, by piercing a predetermined piercing area, wherein a length of the insulating film pattern is longer than a width of the piercing area, wherein the width of the insulation film pattern extends or narrows along direction of the length of the insulation film pattern, and wherein a position of the piercing area is adjusted in extent of the length and in direction of the length of the insulation film pattern.

2. The method according to claim 1, wherein the position of the piercing area is adjusted basing on resistance value obtained by measuring resistance value of a resistor pierced previously in the piercing process.

3. The method according to claim 1, wherein the metal plate is a large size substrate that can produce a plural of pieces.

4. A resistor comprising:

a metal plate as resistance body;

a pair of electrodes formed on one face of the metal plate; and an insulation film formed between the electrodes;

wherein a distance between the electrodes is wider only at one side and narrower only at the other side.

* * * * *